US008449311B2

(12) United States Patent
Montena

(10) Patent No.: US 8,449,311 B2
(45) Date of Patent: May 28, 2013

(54) LOCKING AUDIO PLUG

(75) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 231 days.

(21) Appl. No.: 12/907,592

(22) Filed: Oct. 19, 2010

(65) Prior Publication Data

US 2012/0094521 A1 Apr. 19, 2012

(51) Int. Cl.
*H01R 13/15* (2006.01)

(52) U.S. Cl.
USPC ..... 439/265

(58) Field of Classification Search
USPC ..... 439/349, 350, 352, 265
See application file for complete search history.

(56) References Cited

U.S. PATENT DOCUMENTS

| | | | | | |
|---|---|---|---|---|---|
| 1,353,699 | A | * | 9/1920 | Aguere | 439/256 |
| 1,956,949 | A | * | 5/1934 | Good | 439/269.2 |
| 2,238,834 | A | | 4/1941 | Travers | |
| 2,434,154 | A | * | 1/1948 | Gurin | 439/695 |
| 2,436,586 | A | * | 2/1948 | Mangold | 439/696 |
| 2,449,983 | A | | 9/1948 | Devol | |
| 2,761,110 | A | | 8/1956 | Edlen et al. | |
| 2,780,792 | A | * | 2/1957 | Earl | 439/750 |
| 3,184,706 | A | | 5/1965 | Atkins | |
| 3,336,563 | A | * | 8/1967 | Hyslop | 439/603 |
| 3,394,341 | A | * | 7/1968 | Venn | 439/593 |
| 3,588,786 | A | * | 6/1971 | Alfiero | 439/265 |
| 3,683,320 | A | | 8/1972 | Woods et al. | |
| 3,706,958 | A | | 12/1972 | Blanchenot | |
| 3,723,944 | A | * | 3/1973 | Gauchat et al. | 439/255 |
| 3,789,346 | A | * | 1/1974 | De Brick | 439/283 |
| 3,890,025 | A | * | 6/1975 | Gray | 439/102 |
| 3,894,785 | A | * | 7/1975 | Hubner et al. | 439/825 |
| 4,261,632 | A | | 4/1981 | Narozny | |
| 4,352,240 | A | | 10/1982 | Komada | |
| 4,374,458 | A | | 2/1983 | Komada | |
| 4,374,607 | A | * | 2/1983 | Bright et al. | 439/825 |
| 4,384,758 | A | * | 5/1983 | Lee et al. | 439/265 |
| 4,405,105 | A | * | 9/1983 | Dilmaghani et al. | 244/213 |
| 4,405,195 | A | * | 9/1983 | Cherry et al. | 439/825 |
| 4,553,806 | A | | 11/1985 | Forney, Jr. et al. | |
| 4,557,546 | A | | 12/1985 | Dreyer | |
| 4,591,222 | A | * | 5/1986 | Shaffer | 439/265 |
| 4,688,877 | A | | 8/1987 | Dreyer | |
| 4,789,355 | A | | 12/1988 | Lee | |
| 4,799,902 | A | | 1/1989 | Laudig et al. | |
| 5,066,248 | A | | 11/1991 | Gaver, Jr. et al. | |
| 5,073,129 | A | | 12/1991 | Szegda | |
| 5,108,301 | A | * | 4/1992 | Torok | 439/263 |
| 5,154,637 | A | | 10/1992 | Klug et al. | |
| 5,194,013 | A | * | 3/1993 | Propp | 439/265 |

(Continued)

FOREIGN PATENT DOCUMENTS

DE 4229812 C1 3/1994

*Primary Examiner* — Neil Abrams
*Assistant Examiner* — Travis Chambers
(74) *Attorney, Agent, or Firm* — Schmeiser, Olsen & Watts LLP

(57) ABSTRACT

An audio plug connector device comprising an audio plug body, a connector portion coupled to the audio plug body, and an expanding member extending from the audio plug body, wherein the expanding member radially expands from a first diameter to a second diameter to prevent disengagement from a receptacle is provided. Furthermore, an associated method of locking an audio plug into an audio jack is also provided.

18 Claims, 14 Drawing Sheets

U.S. PATENT DOCUMENTS 5,261,839 A 11/1993 Franks, Jr.
5,318,458 A 6/1994 Thorner
5,362,251 A 11/1994 Bielak
5,470,257 A 11/1995 Szegda
5,482,480 A * 1/1996 Miyazaki ..... 439/774
5,527,190 A 6/1996 Weingartner
5,569,053 A * 10/1996 Nelson et al. ..... 439/668
5,890,925 A 4/1999 Bernardini
5,893,782 A * 4/1999 Harting et al. ..... 439/827
5,997,350 A 12/1999 Burris et al.
6,109,963 A 8/2000 Follingstad et al.
6,116,945 A 9/2000 Davis et al.
6,123,567 A 9/2000 McCarthy
6,146,180 A * 11/2000 Betker et al. ..... 439/352
6,149,469 A 11/2000 Kim
6,153,830 A 11/2000 Montena
6,179,656 B1 1/2001 Wong
6,210,222 B1 4/2001 Langham et al.
6,254,430 B1 7/2001 Endo et al.
6,261,126 B1 7/2001 Stirling
6,331,123 B1 12/2001 Rodrigues
6,517,379 B2 2/2003 Leve
6,558,194 B2 5/2003 Montena
6,568,964 B2 * 5/2003 D'Addario ..... 439/675
6,575,784 B1 6/2003 Yamada
6,644,993 B2 11/2003 Victor
6,676,446 B2 1/2004 Montena
6,705,884 B1 3/2004 McCarthy
6,722,902 B2 4/2004 Kedzierski
6,729,912 B2 5/2004 D'Addario
6,749,454 B2 6/2004 Schmidt et al.
6,764,350 B2 7/2004 Kosmala
6,786,774 B2 9/2004 Haas, II et al.
6,848,940 B2 2/2005 Montena
6,860,760 B2 * 3/2005 Endo et al. ..... 439/578
6,884,113 B1 4/2005 Montena
6,966,796 B2 11/2005 Abe et al.
7,029,326 B2 4/2006 Montena
7,048,579 B2 5/2006 Montena
7,094,103 B2 8/2006 Lai
7,121,872 B1 10/2006 Hanks
7,153,159 B2 12/2006 Burris et al.
7,156,695 B2 * 1/2007 Holliday ..... 439/584
D542,225 S 5/2007 Victor
7,217,155 B2 5/2007 Montena
7,226,320 B2 * 6/2007 Abe et al. ..... 439/668
7,291,031 B2 * 11/2007 Crofoot et al. ..... 439/265
7,311,554 B1 12/2007 Jackson et al.
7,458,849 B2 12/2008 Rodrigues et al.
7,458,851 B2 12/2008 Montena
7,476,119 B2 1/2009 D'Addario et al.
7,488,187 B2 2/2009 Wolf
7,534,124 B1 * 5/2009 Lemaire et al. ..... 439/263
7,611,373 B1 * 11/2009 LaSalvia ..... 439/394
7,806,714 B2 * 10/2010 Williams et al. ..... 439/352
7,841,898 B1 11/2010 Titus
7,857,643 B2 12/2010 Dobler
7,997,929 B2 8/2011 Montena
8,016,615 B2 * 9/2011 Montena ..... 439/580
2003/0207620 A1 11/2003 Haas, II et al.
2003/0224658 A1 12/2003 Koch et al.
2005/0085125 A1 4/2005 Montena
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 6/2010 Nania et al.
2010/0203760 A1 8/2010 Montena
2010/0261381 A1 10/2010 Montena et al.
2011/0039449 A1 2/2011 Montena
2011/0059648 A1 3/2011 Montena
2011/0059649 A1 3/2011 Montena
2011/0237110 A1 9/2011 Montena
2011/0300747 A1 * 12/2011 Montena ..... 439/578
2011/0306226 A1 12/2011 Montena
2011/0306247 A1 12/2011 Montena
2012/0003870 A1 1/2012 Montena
2012/0135629 A1 5/2012 Montena

* cited by examiner

LOCKING AUDIO PLUG

FIELD OF THE INVENTION

The present invention relates to audio plugs, and more specifically to embodiments of an audio plug having a locking body which expands to lock an audio plug into an audio jack.

BACKGROUND OF THE INVENTION

Audio plugs are frequently used to connect audio sources, such as an electric guitar, to sound processing equipment, such as an amplifier or an effect/distortion pedal. Typically, the audio plug engages an audio jack located somewhere on the audio source. However, it is common for the audio source to change position, often abruptly, rapidly, and animatedly while being operated. For example, a musician may manipulate his or her guitar in different directions while jumping to enlarge a stage presence and entertain an audience. This movement creates the potential for the audio plug to become disengaged from the audio source, absent any inherent retention mechanism beyond a light spring metal contact. Various attempts to prevent audio plug disengagement from audio jacks have been made over the years, ranging from taping the cable to a guitar body or strap to a wireless transmitter. However, those solutions have serious drawbacks from lack of aesthetic appeal to radio interference and battery power loss.

Thus, a need exists for an apparatus and method for securing an audio plug within an audio jack that can withstand typical movement encountered when operating an audio source, but which can be easily actuated by a user, and does not require use or installation of special audio jacks or other components.

SUMMARY OF THE INVENTION

A first general aspect of the invention provides an audio plug connector device comprising, an audio plug body, a connector portion coupled to the audio plug body, and an expanding member extending from the audio plug body, wherein the expanding member radially expands from a first diameter to a second diameter to prevent disengagement from a receptacle.

A second general aspect of the invention provides a device comprising, a connector portion, wherein the connector portion receives a coaxial cable, an audio plug attached to the connector portion, the audio plug having an outermost conductor, wherein an expansion of the outermost conductor increases a circumference of the audio plug to tighten interference between the audio plug and a receptacle.

A third general aspect of the invention provides an audio plug comprising, a connector portion having a post, the post having a first end and a second end, wherein a flange is located on the post proximate the second end, a connector body attached to the post, a main body attached to the flange of the post, the main body having an engageable annular portion, and a fastener member attached to the connector body, a tube-like insulator body extending from the post, the insulator body having a first end, a second end, and an actuator positioned somewhere on an outer surface of the insulator body, wherein the insulator body is radially disposed over a pin, the pin having a tip and an inner cavity, the inner cavity having a socket located therein, and a locking body radially disposed over the insulator body, the locking body having a wall thickness that tapers from a first thickness to a second thickness, the second thickness being greater than the first thickness, wherein the actuator engages the locking body to expand a diameter of the locking body when the locking body rotates about the insulator body.

A fourth general aspect of the invention provides a locking audio plug connector comprising, a connector portion having a post, the post having a first end and a second end, wherein a flange is located on the post proximate the second end, a connector body attached to the post, a main body attached to the flange of the post, the main body having an engageable annular portion, and a fastener member attached to the connector body, and an audio plug coupled to the connector portion and configured to be inserted into a receptacle, the audio plug including a tubular member extending from the flange of the post, a pin being generally surrounded by the tubular member, and a shielding member generally surrounding the tubular member, wherein rotation of the shielding member in a first direction places the audio plug in a locked position, and rotation of the shielding member in an opposing second direction returns the audio plug to an unlocked position.

A fifth general aspect of the invention provides a method of locking an audio plug into an audio jack comprising, providing a connector portion having a post, the post having a first end and a second end, wherein a flange is located on the post proximate the second end, a connector body attached to the post, a main body attached to the flange of the post, the main body having an engageable annular portion, and a fastener member attached to the connector body, and an audio plug body having a tube-like insulator body extending from the post, the insulator body having a first end, a second end, and an actuator positioned somewhere on an outer surface of the insulator body, wherein the insulator body is radially disposed over a pin, the pin having a tip and an inner cavity, the inner cavity having a socket located therein, and a locking body radially disposed over the insulator body, the locking body having a wall thickness that tapers from a first thickness to a second thickness, the second thickness being greater than the first thickness, and rotating the locking body in a first direction to place the audio plug body in a locked position, wherein rotation of the locking body in an opposing second direction returns the audio plug body to an unlocked position.

The foregoing and other features of construction and operation of the invention will be more readily understood and fully appreciated from the following detailed disclosure, taken in conjunction with accompanying drawings.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
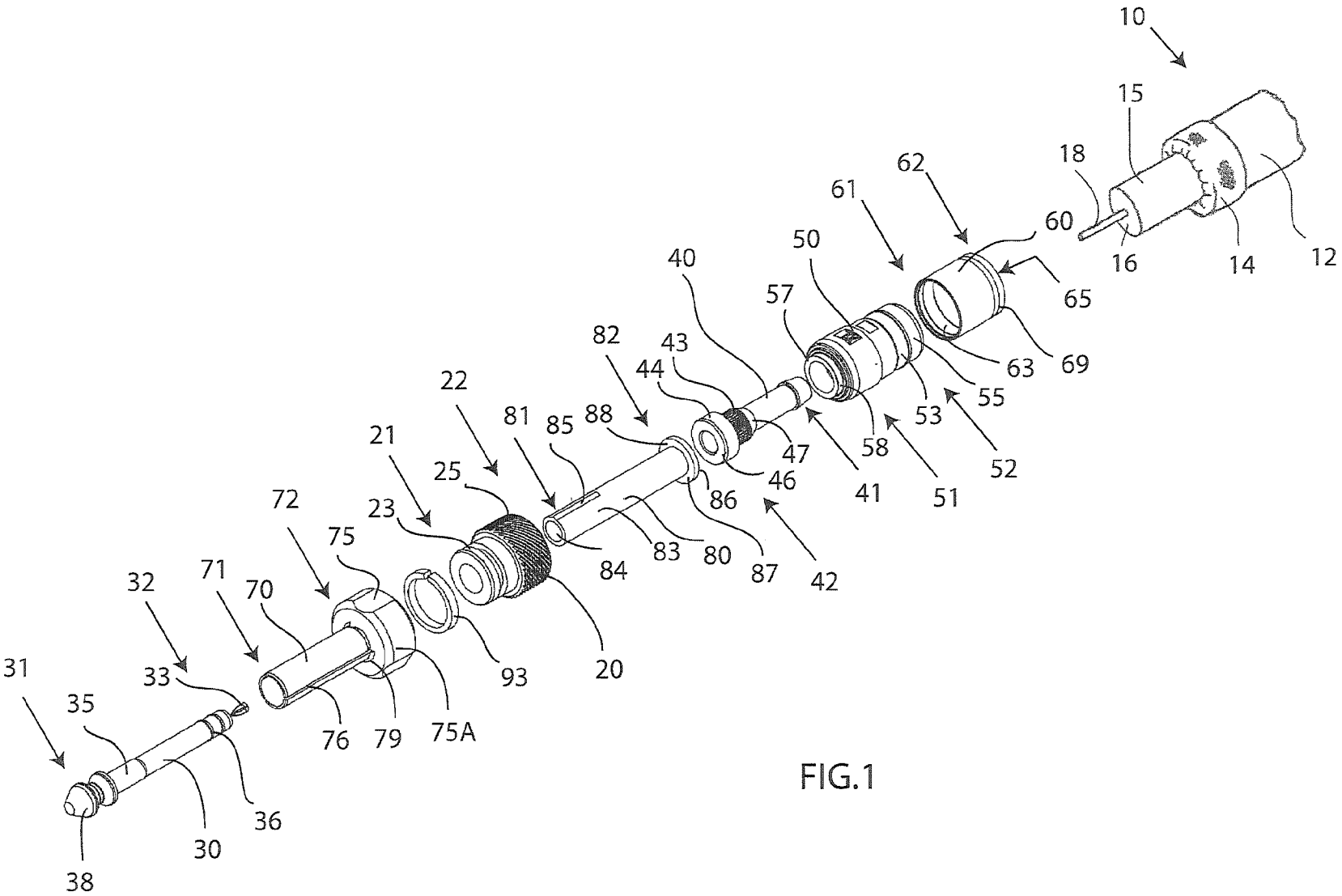
FIG. 1 depicts an exploded perspective view of an embodiment of the elements of an embodiment of an audio plug connector device, in accordance with the present invention.

Referring to the drawings, FIG. 1 depicts one embodiment of an audio plug connector device 100 including embodiments of an audio plug 12 and a connector portion 14. The audio plug body 12 may be coupled to the connector portion 14. In one embodiment, the audio plug body 12 may be coupled to the connector portion 14 in coaxial union (e.g. connected at an angle of 0° or 180°) with the connector portion 14. In another embodiment, the audio plug 12 may be coupled to the connector portion 14 by the use of an additional structural element. In another embodiment, the audio plug 12 may be connected to the connector portion 14 at an angle other than 0° or 180°.

Figure 8:
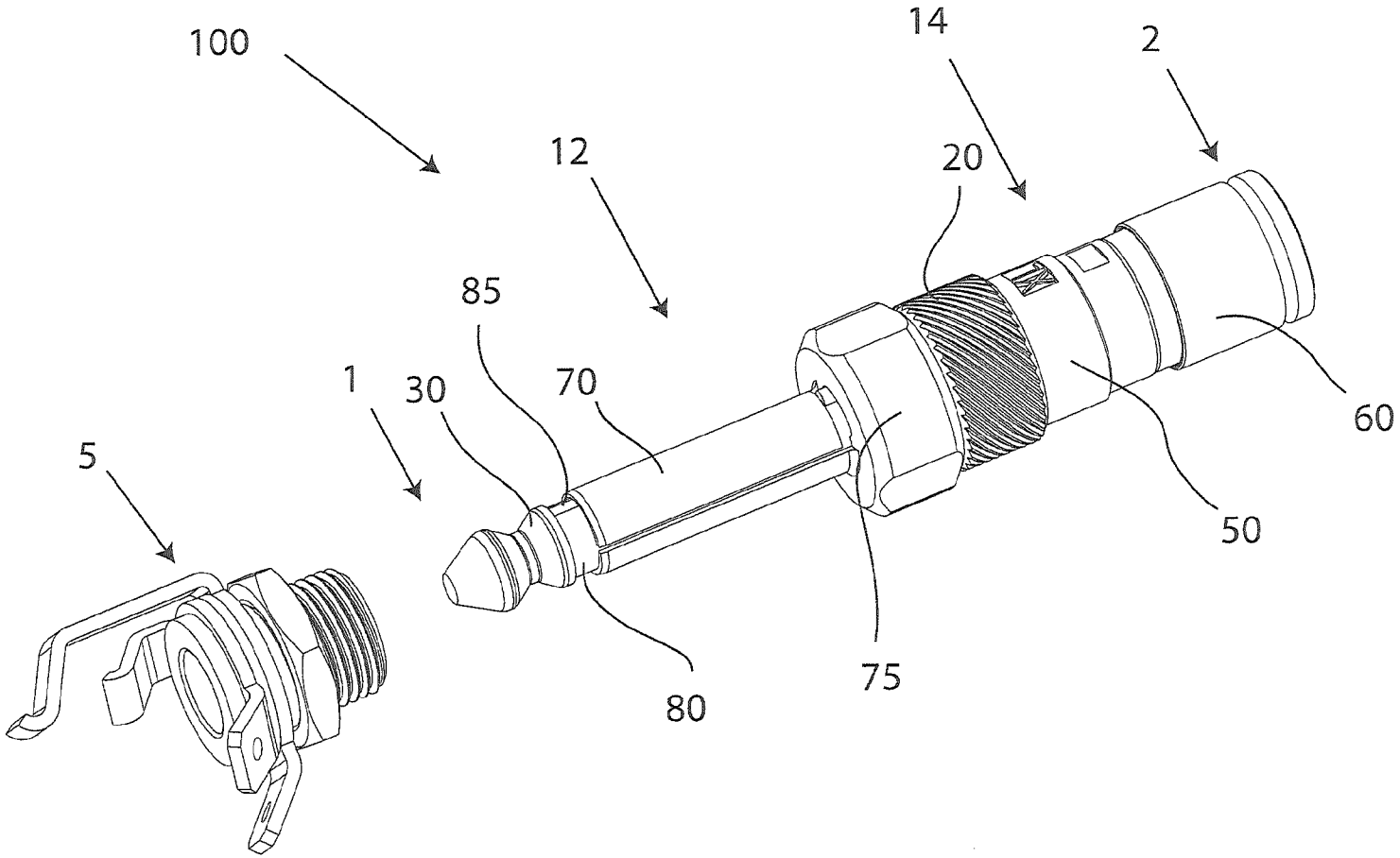
FIG. 8 depicts a perspective view of an embodiment of the audio plug connector device and an embodiment of a receptacle, in accordance with the present invention.
Figure 9:
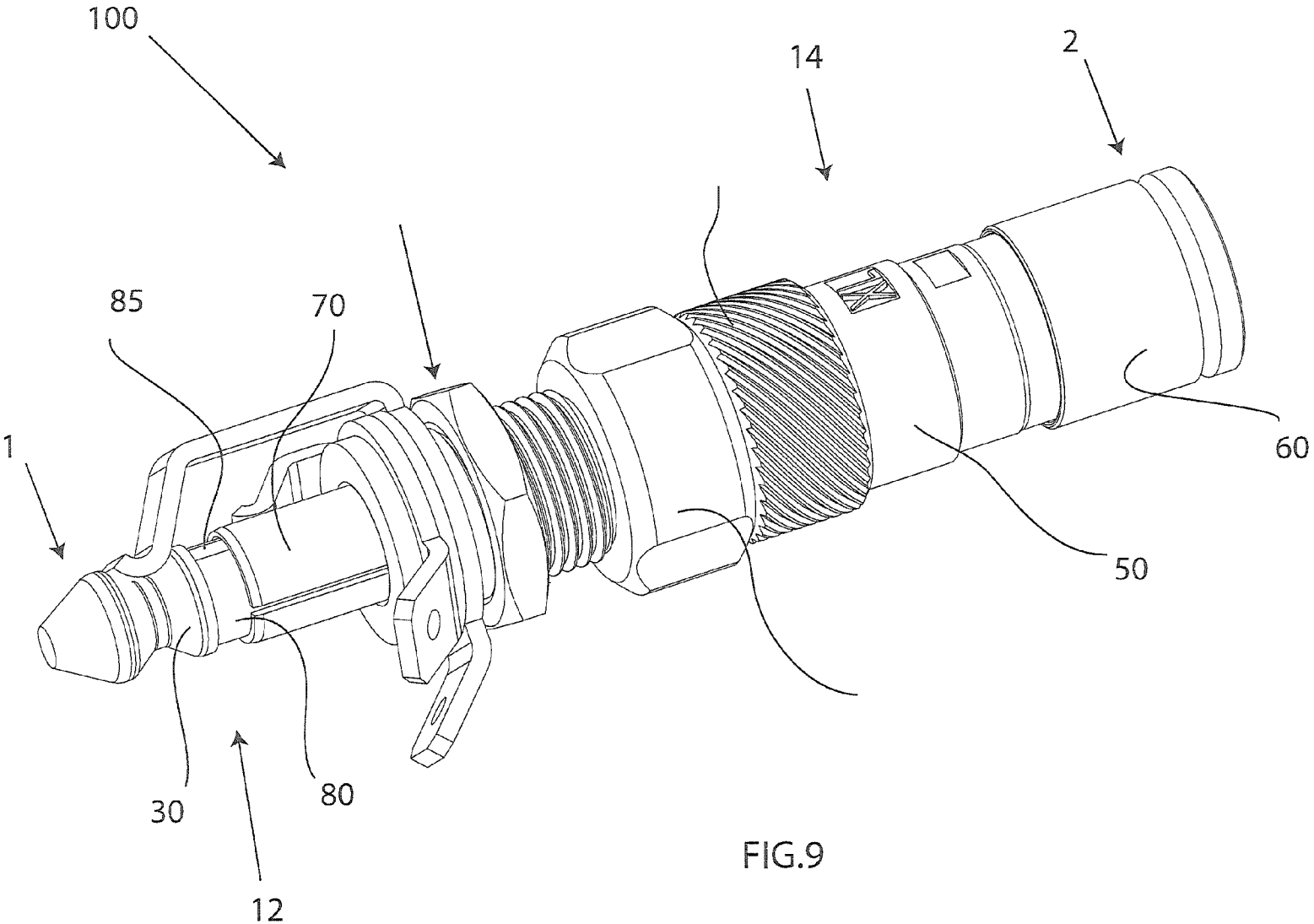
FIG. 9 depicts a perspective view of an embodiment of the audio plug connector device inserted into an embodiment of a receptacle, in accordance with the present invention.

The audio plug connector device 100 has a first end 1 and a second end 2, and can be provided to a user in a preassembled configuration to ease handling and installation during use. Device 100 may comprise a multi-conductor plug, wherein an outermost conductor expands to lock the multi-conductor plug into a corresponding receptacle 5. For example, the circumference of the audio plug 12 may be increased by the expansion of an outermost conductor of the audio plug 12 so that the audio plug 12 has a tighter mechanical interference with the receptacle 5 to prevent inadvertent or unintentional dislocation or disengagement of the audio plug 12 from the receptacle 5. Receptacle 5 may be any audio jack that matingly corresponds to audio plug 12. Receptacle 5 may also have a female socket, or electrical contact, and may be a surface-mounted connector. In many embodiments, the receptacle 5 is fixedly mounted to an audio source. An embodiment of receptacle 5, or jack, is shown in FIGS. 8 and 9. Furthermore, audio plug connector device 100 may also be a locking audio plug for engaging a standard tube-type jack receptacle, the locking phone plug comprising, a plug body, and a tube-like shank extending from the plug body, the tube-like shank including an expanding member, wherein the tube-like shank has an unlocked position with a first diameter, and a locked position wherein the expanding member moves and facilitates an extension of at least a portion of the shank beyond the first diameter. Those in the art should appreciate that the locking audio plug 12 in a jack 5 permits multiple conductor elements and two or more independent audio channels, such as stereophonic sound, and a single audio channel, such as monophonic sound.

The connector portion 14 of device 100 may be operably affixed to a prepared end of a coaxial cable 10 so that the cable 10 is securely attached to the connector portion 14. The coaxial cable 10 may include a protective outer jacket 12, a conductive grounding shield 14, a dielectric foil layer 15, an interior dielectric 16 and a center conductor 18. The coaxial cable 10 may be prepared by removing the protective outer jacket 12 and drawing back the conductive grounding shield 14, or shields 14 to expose a portion of the dielectric foil layer 15 surrounding the interior dielectric 16. Further preparation of the coaxial cable 10 may include stripping the dielectric foil layer 15 and the dielectric 16 to expose a portion of the center conductor. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. Furthermore, there may be more than one grounding shield 14, such as a tri-shield or quad shield cable, and there may also be flooding compounds protecting the shield 14. The dielectric 16 may be comprised of materials suitable for electrical insulation. It should be noted that the various materials of which all the various components of the coaxial cable 10 are comprised should have some degree of elasticity allowing the cable to flex or bend in accordance with traditional broadband communications standards, installation methods and/or equipment. It should further be recognized that the radial thickness of the coaxial cable 10, protective outer jacket 12, conductive grounding shield 14, dielectric foil layer 15, interior dielectric 16 and/or center conductor 18 may vary based upon generally recognized parameters corresponding to broadband communication standards and/or equipment.

With continued reference to FIG. 1, further embodiments of a connector portion 14 may include a post 40, a connector body 50, a fastener member 60, and a main body 20.

An embodiment of a connector portion 14 may include a post 40. The post 40 comprises a first end 41 and opposing second end 42. Furthermore, the post 40 comprises a flange 44, such as an externally extending annular protrusion, located at the second end 42 of the post 40. The flange 44 may include a tapered surface facing the first end 41 of the post 40. Moreover, the post 40 may include a surface feature 47 such as a lip or protrusion that may engage a portion of a connector body 50 to secure axial movement of the post 40 relative to the connector body 50. However, the post may not include such a surface feature 47, and the connector portion 14 may rely on press-fitting and friction-fitting forces and/or other component structures to help retain the post 40 in secure location both axially and rotationally relative to the connector body 50. The location proximate or otherwise near where the connector body 50 is secured relative to the post 40 may include surface features 43, such as ridges, grooves, protrusions, or knurling, which may enhance the secure location of the post 40 with respect to the connector body 50. The post 40 may also include a mating edge 46, which may be configured to make physical and electrical contact with a corresponding mating edge 86 of an insulator body 80. For instance, the mating edge surface 46 of the post 40 abuts, contacts, communicates, borders, touches, presses against, and/or adjacently joins an outer mating edge surface 86 of the insulator body 80.

Moreover, the post 40 should be formed such that portions of a prepared coaxial cable including the dielectric foil layer, the dielectric, and center conductor can pass axially into the first end 41 and/or through a portion of the tube-like body of the post 40. Moreover, the post 40 should be dimensioned such that the post 40 may be inserted into an end of the prepared coaxial cable 10, around the dielectric foil layer 15 surrounding the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

With continued reference to FIG. 1, an embodiment of a connector portion 14 may include a connector body 50. The connector body 50 may comprise a first end 51 and opposing second end 52. Moreover, the connector body may include a post mounting portion 57 and annular detent 58 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector portion 14. In one embodiment, the connector body 50 may be press-fitted onto the outer surface of the post 40. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In one embodiment, the fastener member 60 may be a compression ring. In addition, the fastener member 60 may include an internal annular protrusion 63 located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable. For example, the narrowing geometry will compress squeeze against the cable, when the fastener member 60 is compressed into a tight and secured position on the connector body 50. Additionally, the fastener member 60 may comprise an exterior surface feature 69 positioned proximate with or close to the second end 62 of the fastener member 60. The surface feature 69 may facilitate gripping of the fastener member 60 during operation of the connector portion 14. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable, the fastener member 60 touches or resides substantially proximate or significantly close to the locking knob 75. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Referring still to FIG. 1, further embodiments of connector portion 14 may also include a main body 20. Main body 20 may couple the connector portion 14 to the audio plug 12. Main body 20 may include a first end 21, a second end 22, a ribbed surface 25, a tapered surface 26, an inner edge 24, and an engagement portion 23. The main body 20 may be a tubular, or hollow, cylindrical member having a tapered edge 26 on the inner surfaces of the main body 20, proximate the second end 22 of the main body 20. The tapered edge 26 proximate the second end 22 can accommodate the post mounting portion 57 and annular detent 58 of the connector body 50, proximate or otherwise near the first end 51 of the connector body 50. On the outer surface of the main body 20, may be a ribbed surface 25. The main body also includes an engagement portion 23, which may be annular detent having a smaller circumference than the main body 20. The engagement portion 23 may have threads located on the outer surface of the engagement portion 23 to accommodate the locking body 75. For instance, the locking knob 75 can be rotatably secured to the main body 20, such that the locking knob 75 may achieve rotatable movement about the main body 20. Moreover, an annular protrusion having an inner edge 26 may be located along the inner surface proximate the first end 21 of the main body 20 (shown in FIG. 2). Inner edge 26 physically contacts the flange 87 of the insulator body 80, and operably sandwiches the insulator body flange 87 between the inner edge 26 and the post 40, more specifically, the flange 44 of the post 40. The main body 20, inter alia, surrounds, encompasses, and/or has a radial relationship with a portion of the insulator body 80 (e.g. flange 87), a portion of the post 40 (e.g. flange 44), and a portion of the connector body 50 (e.g. annular detent 58). Conversely, the locking knob 75 surrounds, encompasses, and/or has a radial relationship with a portion of the main body 20 (e.g. engagement portion 23).

In one embodiment, the manner in which the connector portion 14 may be fastened to a coaxial cable 10 may involve compaction of the connector body 50. For example, once received, or operably inserted into the connector 100, the coaxial cable 10 may be securely set into position by compacting and deforming the outer surface 57 of connector body 50 against the coaxial cable 10 thereby affixing the cable into position and sealing the connection. Compaction and deformation of the connector body 50 may be effectuated by physical compression caused by a fastener member 60, wherein the fastener member 60 constricts and locks the connector body 50 into place.

Figure 10:
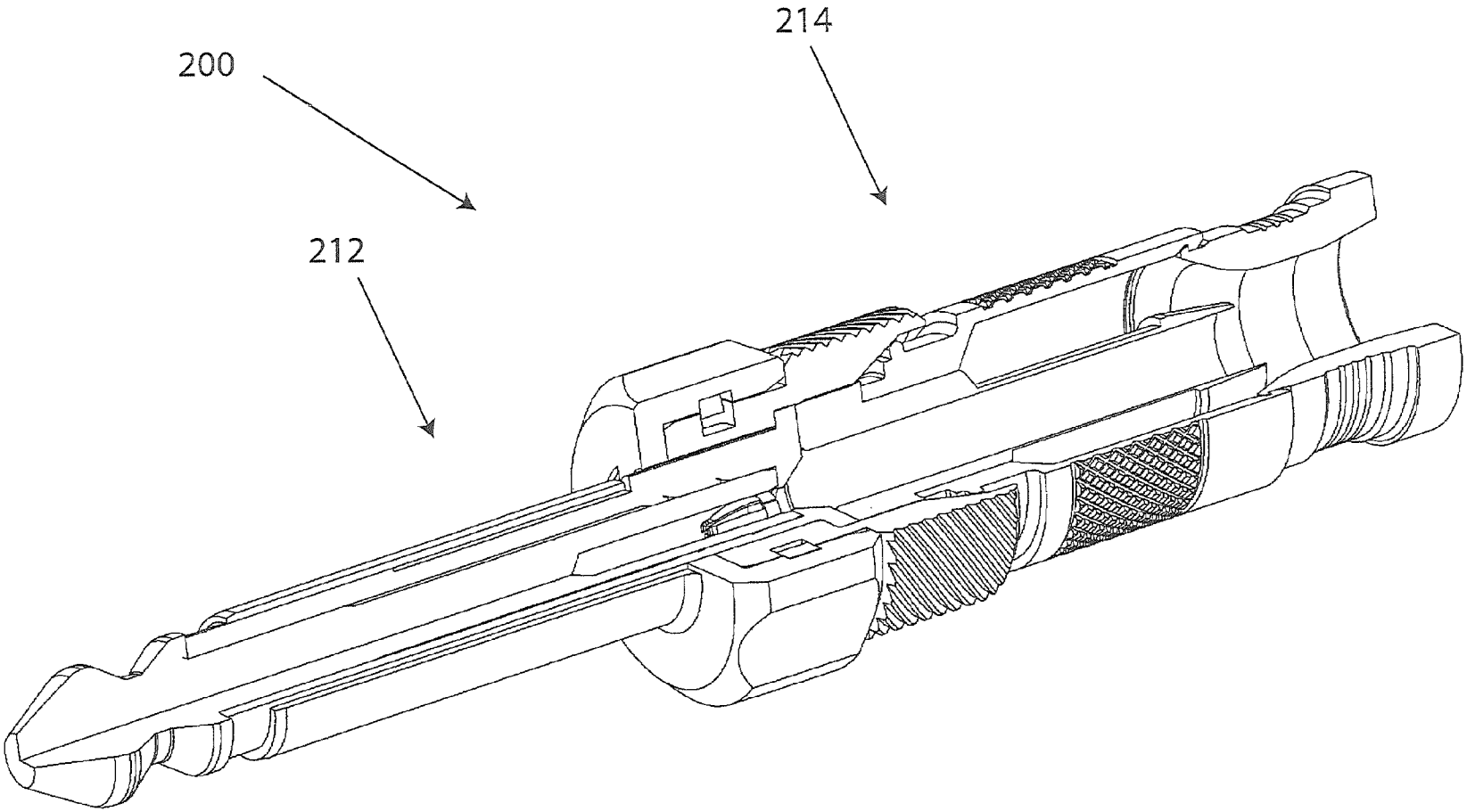
FIG. 10 depicts a perspective cut-away view of a second embodiment of the audio plug connector device, in accordance with the present invention.

In another embodiment, the manner in which the connector portion 14 may be fastened to a received coaxial cable 10 may also be similar to the way a cable is fastened to a connector having an insertable compression sleeve that is pushed into the connector body 50 to squeeze against and secure the cable, as embodied in FIG. 10. The coaxial cable connector portion 14 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield 14, or sheath, of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body 50 and retain the cable and may be displaceable or movable axially or in the general direction of the axis of the connector portion 14 between a first open position (accommodating insertion of the tubular inner post 40 into a prepared cable 10 end to contact the grounding shield 14), and a second clamped position compressibly fixing the cable within the chamber of the connector portion 14, because the compression sleeve is squeezed into retraining contact with the cable within the connector body 50.

Referring again to FIG. 1, embodiments of an audio plug 12 may include a pin 30, an insulator body 80, an actuator 85 located somewhere on the outer surface 83 of the insulator body, a locking body 70, and a locking knob 75 connected to the locking body 70. Audio plug 12 may be any multi-conductor plug, such as a TRS connector, TS connector, phone plug, audio plug, stereo plug, mini-jack, headphone jack, and the like. Audio plug 12 may be a ¼" embodiment, but could also be an audio plug of any size.

Figure 2:
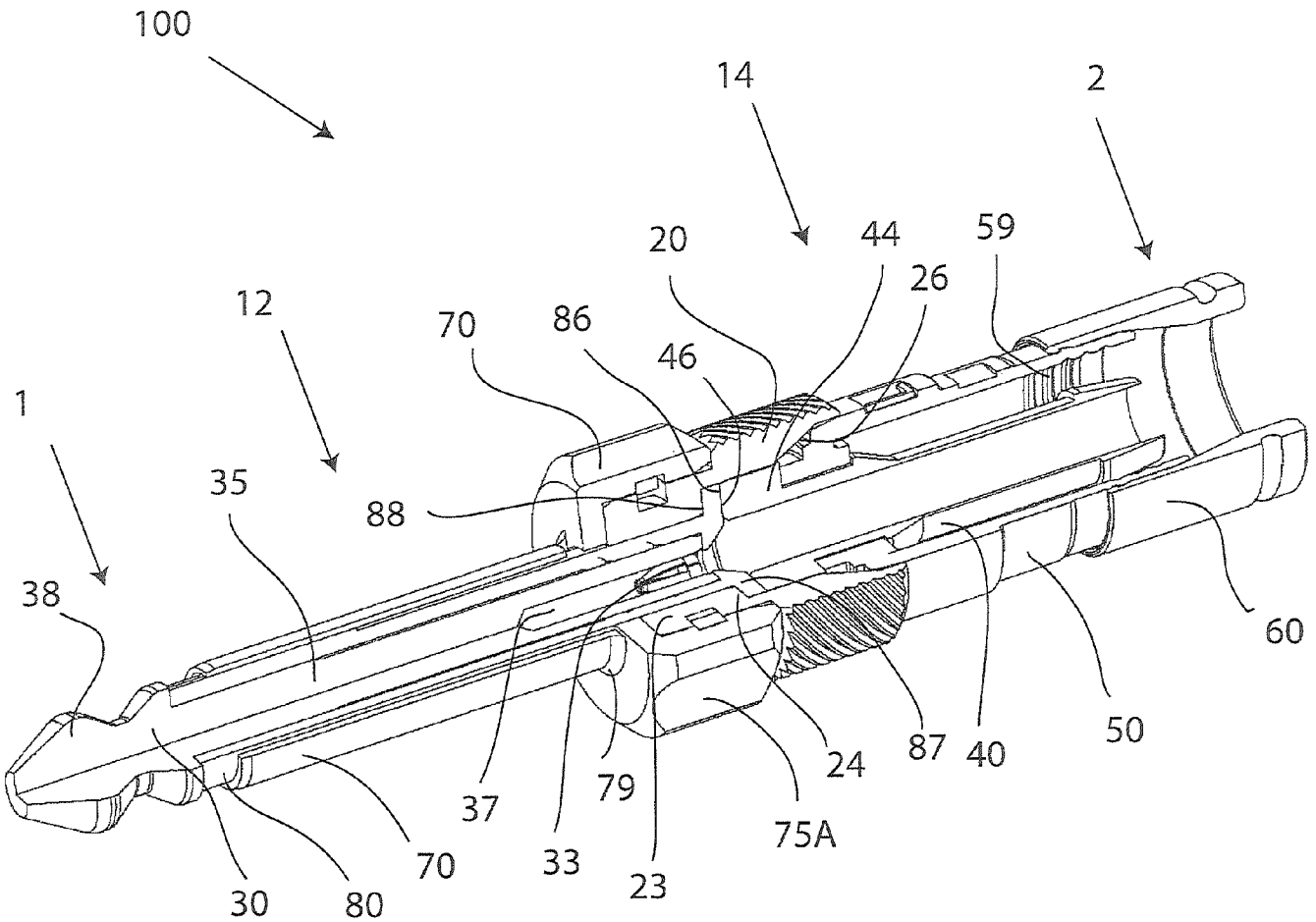
FIG. 2 depicts a perspective cut-away view of an embodiment of the audio plug connector device, in accordance with the present invention.

An embodiment of an audio plug 12 may include a pin 30. Pin 30 may include a first end 31 and a second end 32, a stem 35 having radially extending ribs 36, a bore 37, and a tip 38. Pin 30 and its components should be fabricated of a conductive material such as brass, copper, or stainless steel, and may be plated for wear resistance and corrosion resistance. An insulator body 80 can be disposed radially on pin 30. Ribs 36 on stem 35 may assist in maintaining the insulator body 80 on stem 35. The pin 30 may be configured with thin walls or slotted sections that make an electrical connection with the central conductor of a cable. The configuration of the pin 30 should not be limited to any such configuration, and may include any configuration that allows electrical contact with the central conductor. A pin 30 may include a bore 37 and a socket 33 located therein for establishing and maintaining physical and electrical contact with the center conductor. For example, a socket 33 can be positioned in bore 37 located within the pin 30 for making physical and electrical contact between pin 30 and the central conductor of a cable, as depicted in FIG. 2. Bore 37 may be any void, space, cavity, opening, etc. located within the pin 30 that can accommodate, accept, house, contain, etc. a center conductor of a coaxial cable.

An embodiment of an audio plug 12 may include an insulator body 80. Insulator body 80 can be a hollow, tubular member, a cylindrical member, or shank member. In an assembled embodiment of device 100, the insulator body 80 extends from proximate or otherwise near the second end 42 of the post 40 to proximate or otherwise near the first end 31 of the pin 30. Those having skill in the art should appreciate that the diameter, length, circumference, and other geometrical or structural aspects of the insulator body 80 may vary according to dimensions and requirements of device 100. Moreover, the insulator body 80 includes a flange 87, such as an externally extending annular protrusion, located at the second end 82 of the insulator body 80. The insulator body flange 87 includes an outer mating edge surface 86 and an inner mating edge surface 88. The outer mating edge surface 86 directly and physically contacts the flange 44 of the post 40 while operably configured, such that physical communication is established and maintained between the insulator body 80 and the post 40. Furthermore, the inner mating edge surface 88 directly and physically contacts an inner edge 24 of the main body 20. Radial compressive forces and generally mechanical forces exerted by the main body 20 while operably configured, coupled with the mechanical positioning of the post 40 secures the placement of the insulator body flange 87 against the flange 44 of the post 40. Alternatively, each component may be press-fit, soldered, or secured through various methods used to secure the connector portion 14 and audio plug 12 components in place. The insulator body 80 may also encompass, engage, accommodate, house, accept, or secure the pin 30; the insulator body 80 may also generally or substantially surround, or have a radial relationship with the pin 30. For example, a pin 30 may be axially aligned within the insulator body 80, wherein the pin 30 is axially inserted inside the tube-like member at a first end 81 and passed through towards a second end 82 until a second end 32 of the pin 30 physically engages a portion of the insulator body flange 87, impeding further axial movement within the insulator body 80, as embodied by FIG. 2 The insulator body 80 should be made of a rigid, insulating material, such as plastic, hard plastic, fiberglass, composites, and the like.

Located somewhere on an outer surface 83 of the insulator body is an actuator 85. An actuator 85 may be any rigid (non-flexible) protrusion from the outer surface 83 of the insulator body 80. There may be more than one protruding actuator 85 located on the outer surface 83, and they may be spaced away from each other in any sequence, or may be in constant contact with each other. In one embodiment, the actuator 85 may be a cam feature, longitudinally or axially extending along the insulator body 80 beginning from proximate or otherwise near the first end 81 of the insulator body 80 towards the second end 82 of the insulator body 80. Conversely, in another embodiment, the actuator 85 may longitudinally or axially extend from proximate or otherwise near the second end 82 of the insulator body 80 towards the first end 81 of the insulator body 80. In another embodiment, the actuator 85 may be an expanding ridge, wherein a ridge forms longitudinally along the insulator body 80, further wherein the tip of the ridge is a distance beyond, or higher, than the outer surface 83. It should further be appreciated that the actuator 85 need not extend longitudinally or axially along the insulator body 80. For example, the actuator 85 may be positioned in any orientation with respect to the outer surface 83 of the insulator body 80. The actuator 85 may also be any geometrical shape (e.g. spherical, cylindrical, etc.) and may be dimensioned having any thickness, height, length, volume suitable to engage the locking body 70, described in further detail infra. Other embodiments of the actuator 85 may include a single bump (curvilinear or non-curvilinear), a plurality of bumps (curvilinear or non-curvilinear), a single rib (annular or semi-annular), a plurality of ribs (annular or semi-annular), and the like located on the outer surface 83 of the insulator body 80. In an alternative embodiment, an external protrusion similar to the embodiments of actuator 85 may be located on the inner surface, or underside, of the locking body 70 and may function as an actuator to lock audio plug 12 into a receptacle 5. For example, the insulator body 80 may include a tapered surface, such that the thickness gradually yet suitably increases in a radial direction, similar to the varying thickness of the locking body 70, described in greater detail infra.

Figure 3:
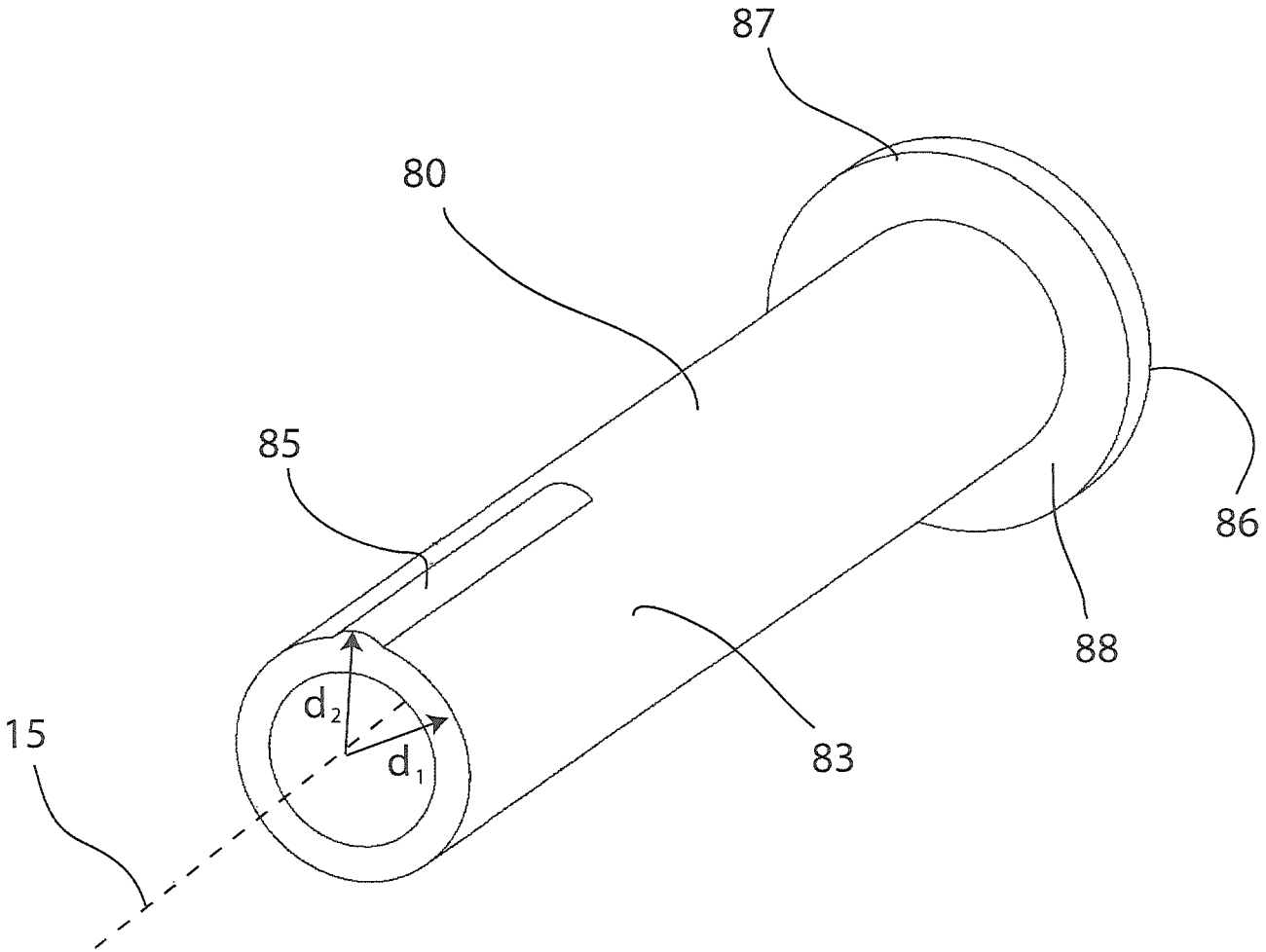
FIG. 3 depicts a perspective view of an embodiment of an insulator body having an embodiment of an actuator, in accordance with the present invention.

Referring still to the drawings, FIG. 3 depicts an embodiment of an insulator body 80 having an actuator 85 located somewhere on the outer surface 83 of the insulator body 80. The presence of the actuator 85 on the outer surface 83 of the locking body 80 can increase the diameter of the insulator body 80 where the actuator 85 is located. For example, the diameter of the insulator body 80 measured from the central axis 105 will be greater when measured to the tip, or top, of an actuator 85 located on the outer surface 83. Thus, the insulator body 80 may have a first insulator diameter, $d_1$, which facilitates an audio plug 12 being in an unlocked position 105, and a larger, second insulator diameter, $d_2$, which facilitates the audio plug 12 being in a locked position 110 (shown in FIG. 7). The second insulator diameter, $d_2$, is a distance beyond the first insulator diameter, $d_1$.

Figure 4A:
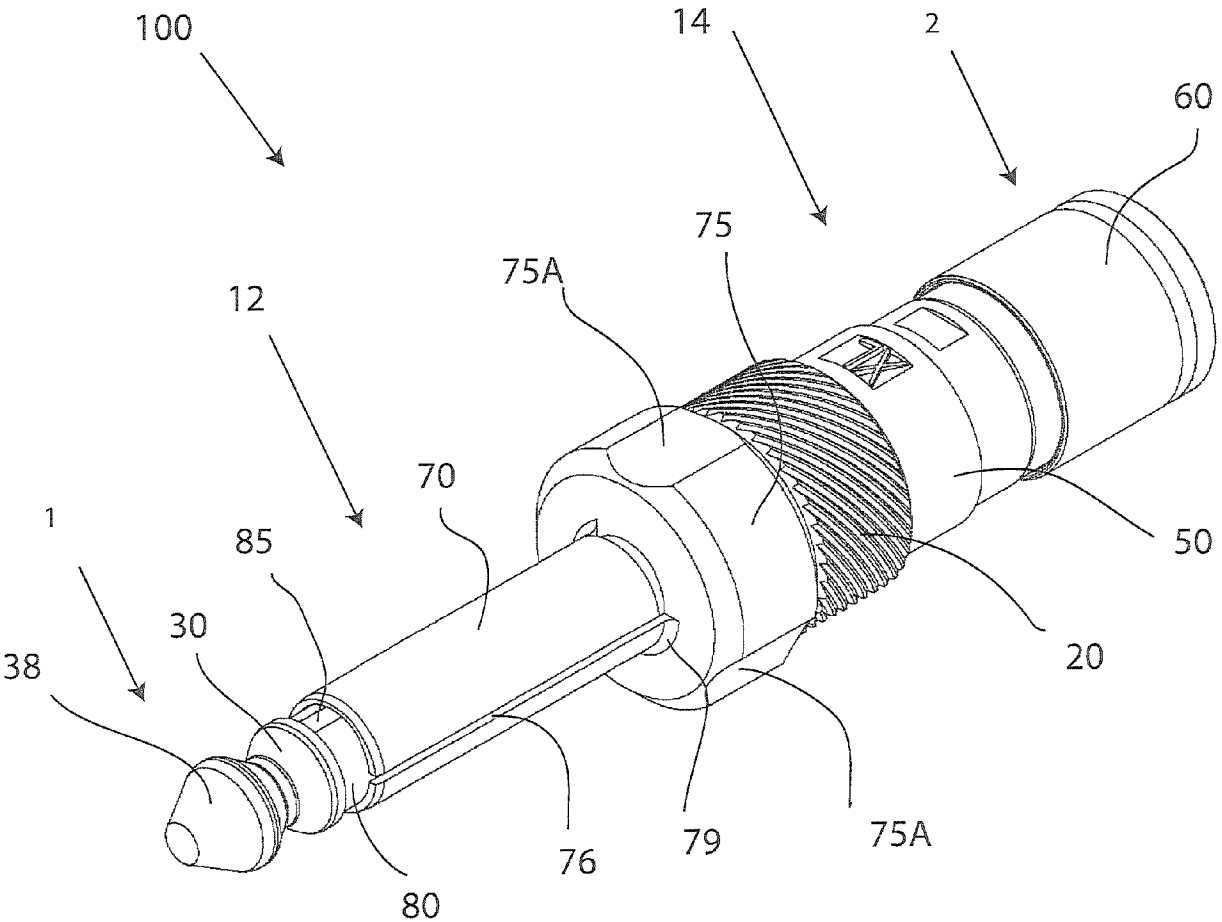
FIG. 4A depicts a perspective view of an embodiment of the audio plug connector device, in accordance with the present invention.
Figure 4B:
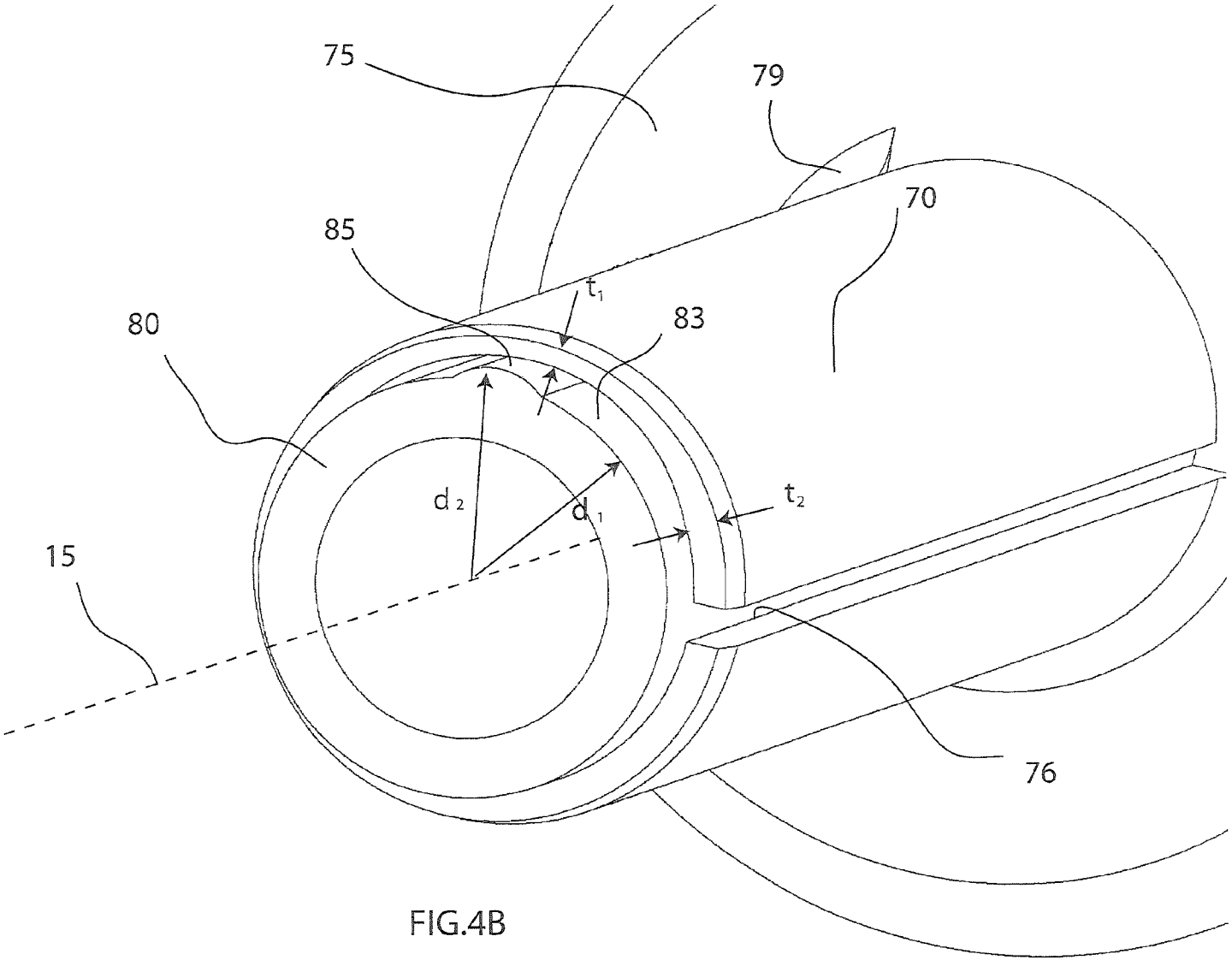
FIG. 4B depicts a magnified perspective view of an embodiment of an insulator body generally surrounded by an embodiment of a locking body, in accordance with the present invention.

Referring now to FIGS. 4A and 4B, further embodiments of audio plug 12 may include a locking body 70 having a locking knob 75 connected thereto. The locking body 70 can be a hollow, tubular member, or a generally cylindrical member, and may be referred to as a shield. The locking body 70 should be constructed out of conductive material. For example, the locking body 70 may be made of brass, stainless steel, and may be plated for wear resistance and corrosion resistance. The locking body 70 may have a thin slot 76, or space, longitudinally running along the locking body 70, extending from a first end 71 to a second end 72. The slot 76 need not extend entirely from the first end 71 to the second end 72, or vice versa. The slot 76 is optional; however, it may help prevent disengagement of the audio plug 12 from receptacle 5. Furthermore, a locking knob 75 can be connected to the locking body 70 proximate the second end 72 of the locking body 70. In addition, the locking knob 75 may be radially disposed on the locking body 70 at the second end 72. The locking knob 75 may be a wheel, a rotatable element, a rotatable member, a gripping wheel, a ring, and the like. In many embodiments, the locking knob 75 is rigidly connected to the locking body 70. The locking knob 75 being rigidly connected to the locking body 70 should mean that if the locking knob 75 is twisted or rotated (about the central axis 15), the locking body 70 shall also twist or rotate in coaxial and/or general union. An annular, or semi-annular tapered edge 79 may be positioned proximate the second end 72, wherein a portion of the tapered edge 79 physically contacts the locking knob 75, and another portion physically contacts the locking body 70. The locking knob 75 may contain one or more finger and thumb gripping areas 75A on the outer edge of the locking knob 75 to facilitate convenient and effective gripping, twisting, and rotating of the locking knob 75, which ultimately twists and/or rotates the locking body 70 in coaxial union. However, the locking body 70 may be twisted and/or rotated without the use of the locking knob 75 by gripping the outer surface 83 of the locking body 70 and twisting and/or rotating the locking body 70. Furthermore, the locking knob 75 can be attached, affixed, secured, etc to the main body 20. In one embodiment, the locking knob 75 may be threaded onto the engagement portion 23 of the main body, such that the locking body 75 is rotatably secured to the main body 20. For instance, the locking knob 75 may rotate about the main body 75. A retaining ring 93 may be positioned between the connection of the main body 20 and the locking knob 75.

Figure 5:
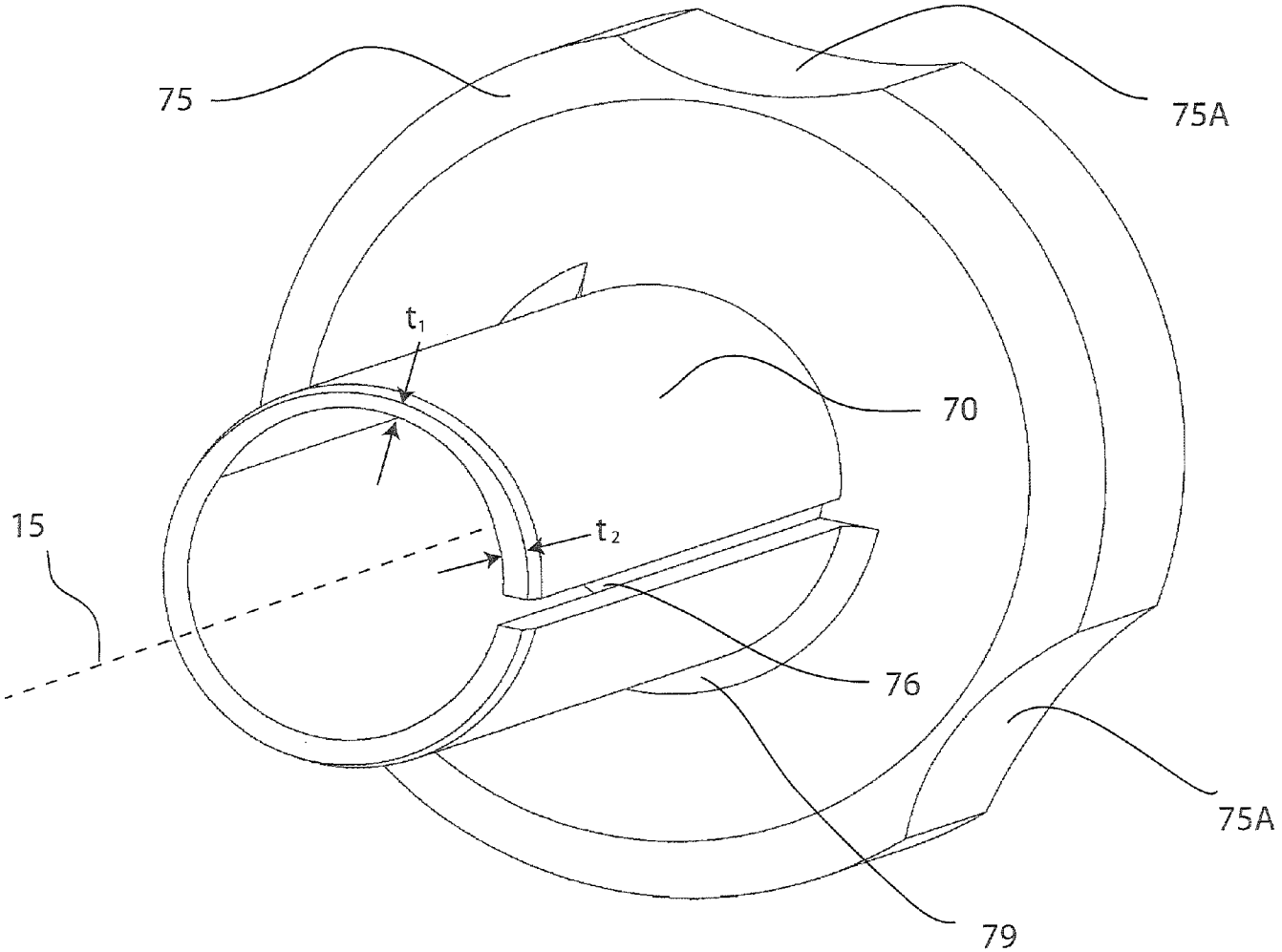
FIG. 5 depicts a perspective view of an embodiment of a locking body connected to an embodiment of a locking knob, in accordance with the present invention.

Moreover, the locking body 70 may encompass, engage, accept, generally and/or substantially surround, or have a radial relationship with the insulator body 80. For example, the insulator body 80 may be axially aligned inside the locking body 70. For example, the locking body 70 may be a shield covering the insulator body 80. The locking body 70 should be a flexible, or resilient, member capable of expansion; the locking body 70 may also be referred to as an expansion or expanding member. In many embodiments, the locking body 70 may undergo radial expansion, or outward expansion in a direction radially away from a central axis 15. The radial expansion of the locking body 70 can be caused by the physical/mechanical engagement of the inner surface 74 of the locking body 70 and the actuator 85 located on the outer surface 83 of the insulator body 80. The amount of radial expansion increases as the locking knob 75 is twisted and/or rotated towards the locked position 110. The locking body 70, or wall of the locking body 70, does not have a uniform thickness; the thickness of the wall of the locking body 70 gradually yet suitably increases (i.e. tapers) from a first thickness, $t_1$, to a greater, second thickness, $t_2$, which facilitates the expansion of the locking body 70 and the locking of the audio plug 12 into a receptacle 5, as depicted in FIG. 5. The device 100 may switch from an unlocked position 105, wherein removal of the audio plug 12 may be effortless, and no expansion of the locking body 70 may occur, to a locked position 110, wherein the locking body 70 expands to help prevent disengagement of the audio plug 12 from the audio jack 12

Figure 6:
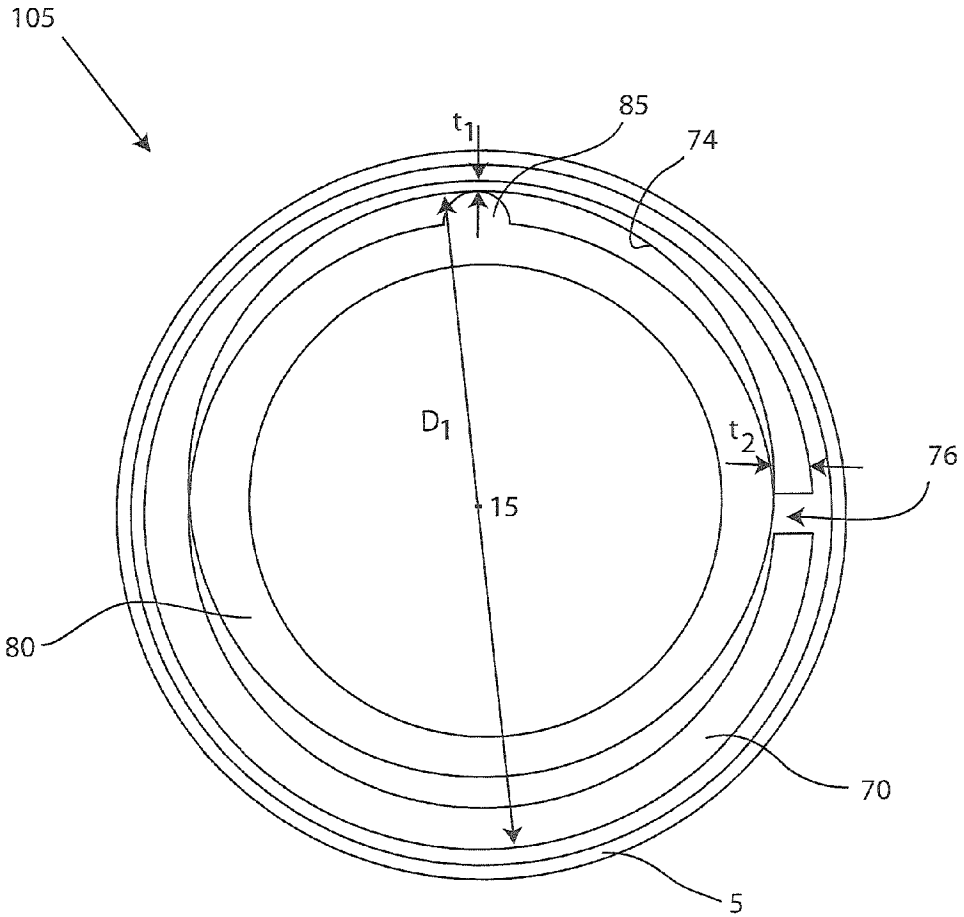
FIG. 6 depicts a perspective view of an embodiment of the audio plug connector device in an unlocked position, in accordance with the present invention.

FIG. 6 depicts an embodiment of audio plug 12 in an unlocked position 105, wherein the actuator 85 either may not engage the inner surface 74, or may engage the inner surface 74 but exert a relatively negligible force so as to not radially expand the locking body 70. Portions of the locking body 70 may contact the insulator body 80 at locations other than where the actuator 85 contacts the locking body 70. However, the contact at those locations may not act upon the locking body 70 to cause radial expansion. The device 100 (or audio plug 12) is typically in the unlocked position 105 when the audio plug is being inserted into a receptacle 5, and immediately thereafter.

Figure 7:
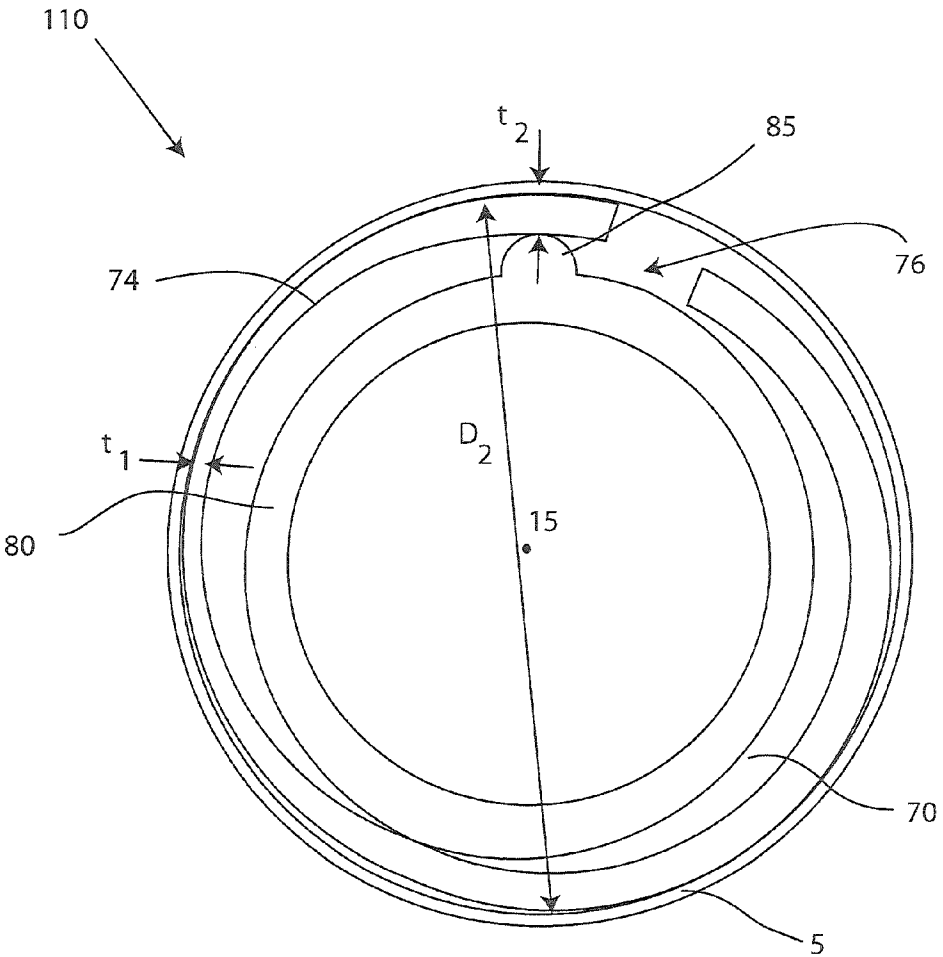
FIG. 7 depicts a perspective view of an embodiment of the audio plug connector device in a locked position, in accordance with the present invention.

FIG. 7 depicts an embodiment of audio plug 12 in a locked position 110. In a locked position 110, the locking body 70 has expanded while inside receptacle 5 to help prevent disengagement of the audio plug 12 from the receptacle 5. As the locking body 70 or the locking knob 75 is twisted and/or rotated in a direction such that the thicker portion of the locking body 70 wall travels towards the actuator 85, the inner surface 74 of the locking body 70 begins to engage, or further engages the actuator 85. The actuator 85, being rigid, exerts a reactive force (i.e. pushes up against) the inner surface 74 of the locking body 70. Because the locking body 70 is resilient and flexible, the engagement of the inner surface 74 and the actuator 85 (i.e. forces exerted onto the inner surface 74 by the actuator 85) can cause the locking body 70 to radially expand outward from the center axis 15. The more the locking body 70 is twisted and/or rotated from the first thickness, $t_1$, position to the second thickness $t_2$, position, the more the flexible locking body 70 radially expands to lock an audio plug 12 into a receptacle 5. Twisting and/or rotation may no longer be needed to lock the device 100 into a receptacle 5 once the actuator 85 engages the locking body 70 wall at or near the second thickness, $t_2$. In most embodiments, only a ⅛ or ¼ turn relative to the main connector body 20 is needed to expand the locking body 70 and achieve a locked position 110. A substantially equal twist and/or rotation in the opposite direction will release the audio plug 12 from the jack 5 and return the device 100 into an unlocked position 105.

In other words, the locking body 70 has an unlocked position 105 with a first diameter, $D_1$, and a locked position 110 with a second diameter, $D_2$, wherein the locking body 70 moves to facilitate an expansion of at least a portion of the locking body 70. Accordingly, the first diameter, $D_1$, may represent the diameter of the audio plug 12 in the unlocked position 105, wherein the thickness of the locking body 70 when directly positioned over the actuator 85 is proximate a first thickness, $t_1$, and the second diameter, $D_2$, may represent the diameter of the audio plug 12 in the locked position 110 wherein the thickness of the locking body 70 when directly positioned over the actuator 85 is proximate a larger, second thickness, $t_2$.

Referring again to the drawings, FIG. 8 and FIG. 9 depict embodiments of an audio plug 12 and a receptacle 5, or audio jack. FIG. 8 shows an embodiment of an audio plug 12 and a receptacle 5 before insertion of the audio plug 12 into the receptacle 5. FIG. 9 depicts an embodiment of an audio plug 12 inserted into a receptacle 5. Once inserted into a receptacle 5, one could simply twist and/or rotate the locking knob 75, which is connected to the locking body 70, to lock the audio plug 12 into the receptacle 5 because the locking body 70 radially expands outward against the inner walls of the receptacle 5.

Therefore, the minimal twisting required to radially expand the locking body 70 to lock the audio plug 12 into a receptacle 5 may circumvent other problems such as lack of aesthetic appeal, radio interference and battery power loss when using a wireless transmitter, while remaining compact and retaining advantages of a compression fit on coaxial cable connector portion 14. Furthermore, the outward radial expansion of the locking body 70 exerts mechanical forces, for example, normal and frictional forces, against the inner walls of a receptacle 5, which may prevent disengagement of the audio plug 12 from the receptacle 5. However, the walls of the jack 5 must be able to withstand the expansive forces exerted by the radially expanding locking body 70 while in the locked position 110. In many embodiments, the accepting audio jacks 5 are solid metal, tube-type jacks, or possess characteristics and/or properties to withstand such forces present when the device 100 is in the locked position 110.

FIG. 10 depicts an embodiment of audio plug connector device 200 comprising an audio plug 212 and a connector portion 214. Audio plug 212 shares the same properties, characteristics, components, structure, and function of audio plug 12. Connector portion 214 may be a "CMP"-type connector. For instance, connector portion 214 can include an insertable compression sleeve that is pushed into the connector body 250 to squeeze against and secure a received cable.

Figure 11:
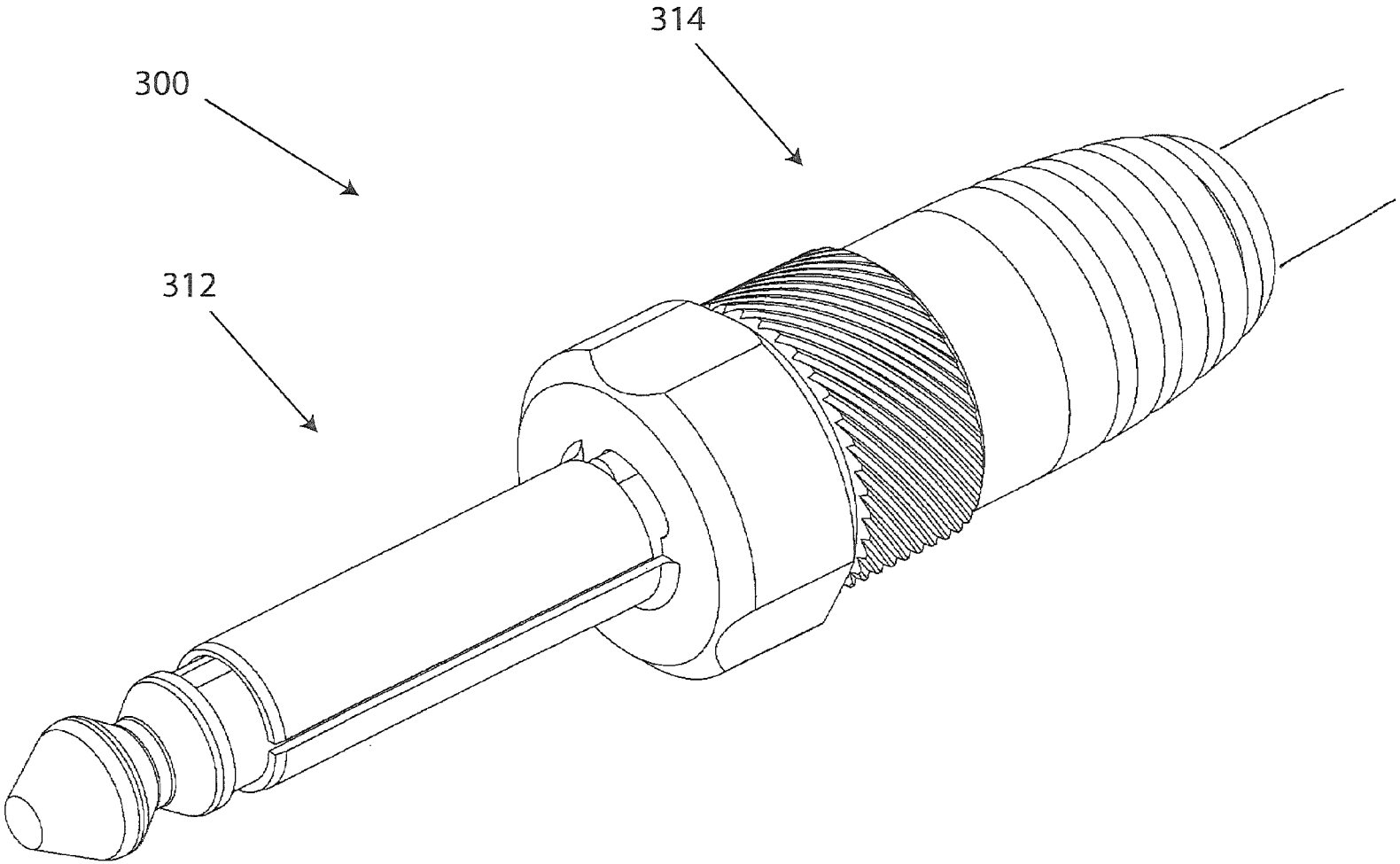
FIG. 11 depicts a perspective cut-away view of a third embodiment of the audio plug connector device, in accordance with the present invention.

FIG. 11 depicts an embodiment of audio plug connector device 300 comprising an audio plug 312 and a connector portion 314. Audio plug 312 shares the same properties, characteristics, components, structure, and function of audio plug 12. However, connector portion 314 and its components may be overmolded to form connector portion 314. Overmolding may be a plastic or thermoplastic coating over a coaxial cable and various components. Additionally, connector portion 314 may be formed by injection molding of the components of connector 314. The overmold of components of audio plug connector device 300 may function as an environmental sealant from environmental contaminants, such as moisture. Further advantages of overmolding may be reduced manufacturing costs, greater freedom to modify design (aesthetic design), resistance to shock and vibrations, improved strain relief, suitable for slight bending or flexing of cable, and ease of assembly. Those having skill in the requisite art should appreciate the further advantages of overmolded components, similar to the overmold present in audio plug connector device 300.

Figure 12:
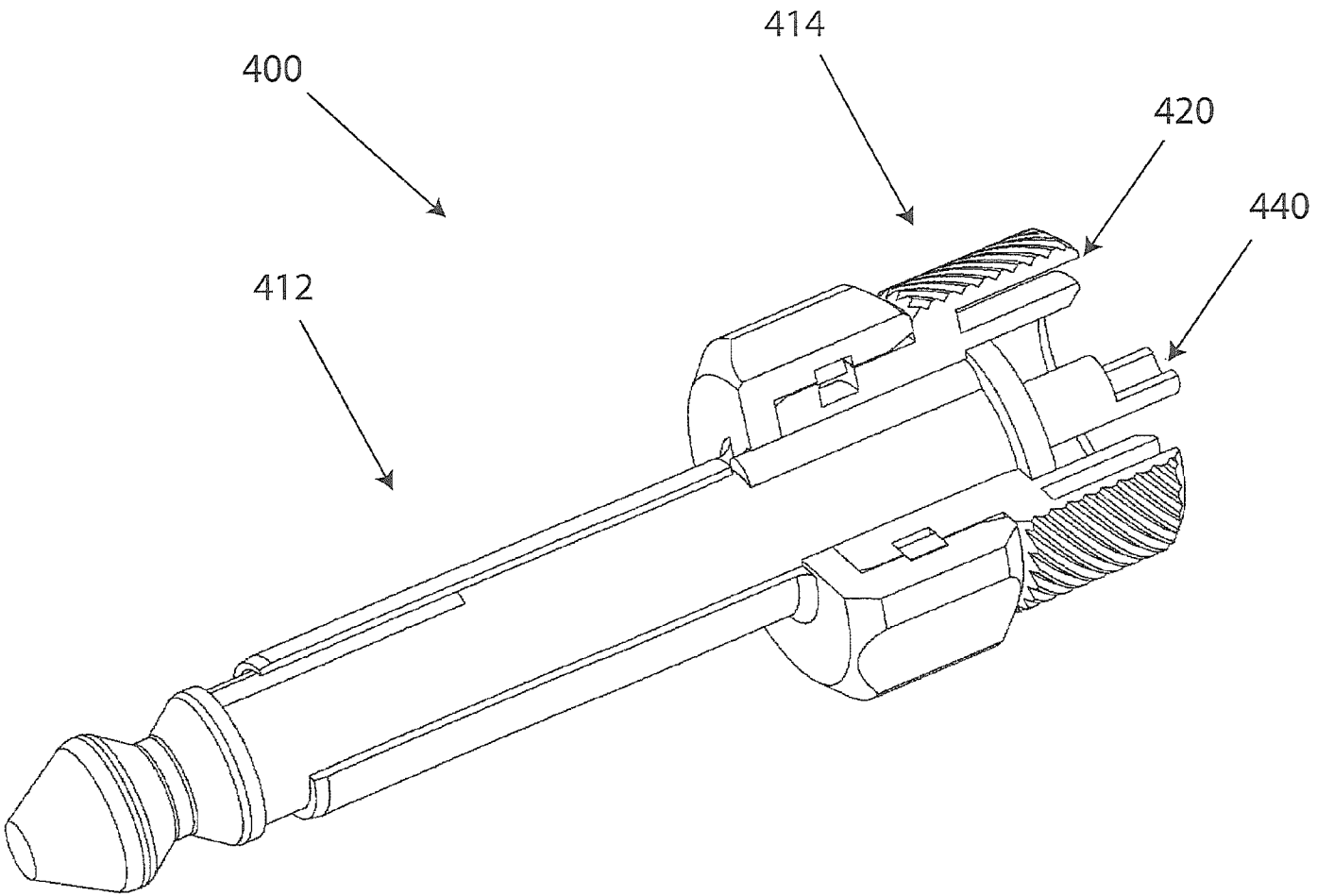
FIG. 12 depicts a perspective cut-away view of a fourth embodiment of the audio plug connector device, in accordance with the present invention.

FIG. 12 depicts an embodiment of audio plug connector device 400 comprising an audio plug 412 and a connector portion 414. Audio plug 412 shares the same properties, characteristics, components, structure, and function of audio plug 12. However, connector portion 414 may include soldering points for various components. For instance, connector portion 414 may include a solder point for a ground shield 420 and a solder point for signal wire 440. Alternatively, the wire may not be coaxially located, but may be located either in a parallel or twisted pair arrangement wherein the grounding point for the wire may be a single non-cylindrical location on 420. These components may be soldered to connector portion 414 at their respective soldering points 420, 440.

Figure 13:
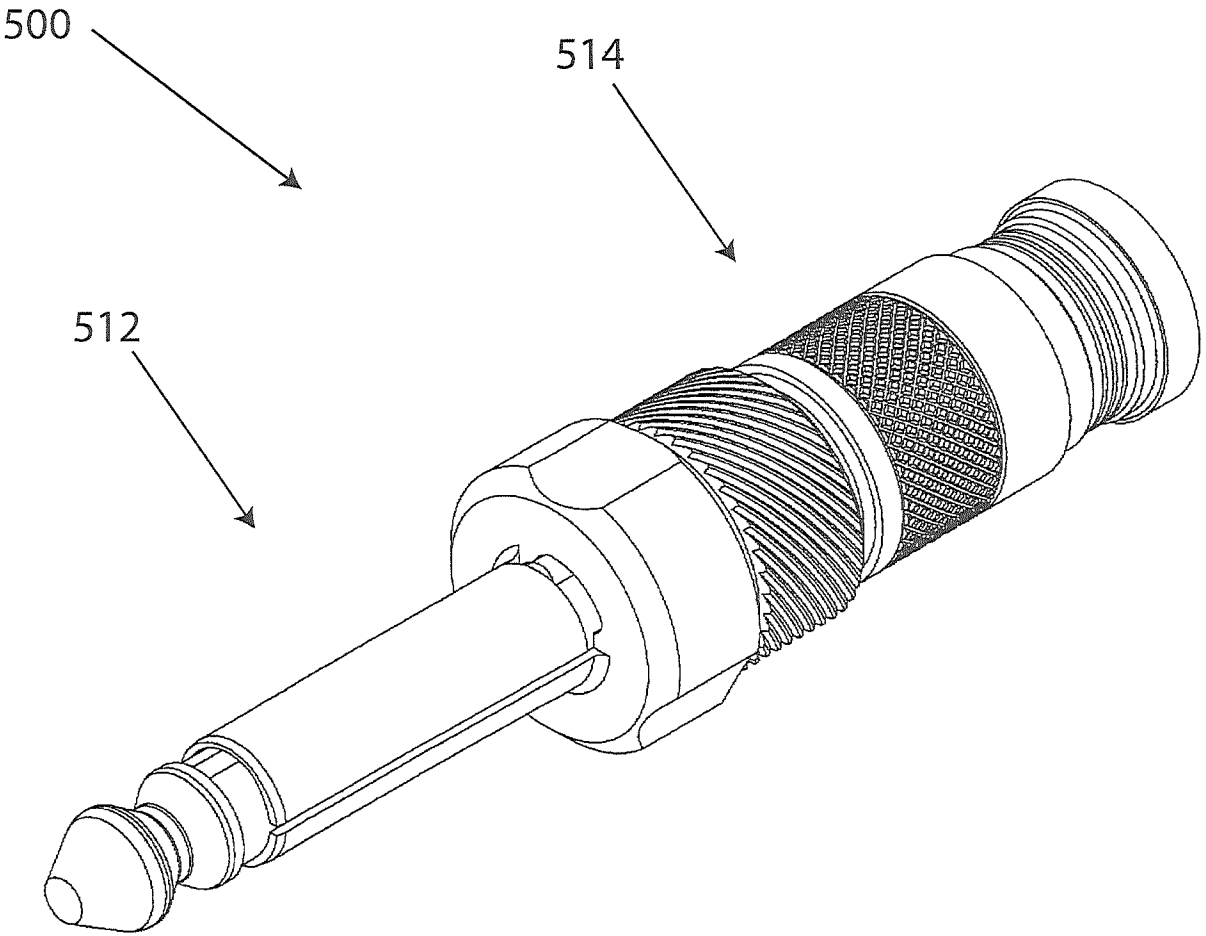
FIG. 13 depicts a perspective cut-away view of a fifth embodiment of the audio plug connector device, in accordance with the present invention.

FIG. 13 depicts an embodiment of audio plug connector device 500 comprising an audio plug 512 and a connector portion 514. Audio plug 512 shares the same properties, characteristics, components, structure, and function of audio plug 12. However, connector portion 514 may be connected to coaxial cable 10 through crimping. For instance, once received, or operably inserted into the connector 100, the coaxial cable 10 may be securely set into position by compacting and deforming the outer surface 57 of connector body 50 against the coaxial cable 10 thereby affixing the cable into position and sealing the connection. For example, where the connector body 50 is formed of materials having and elastic limit, compaction and deformation may be accomplished by crimping tools, or other like means that may be implemented to permanently contort the outer surface 57 of connector body 50 into a securely affixed position around the coaxial cable 10.

Referring back to FIGS. 1-9, a method of locking an audio plug 12 into a receptacle 5 may comprise the steps of providing a connector portion 14 having a post 40, the post having a first end 41 and a second end 42, wherein a flange 44 is located on the post 40 proximate the second end 42, a connector body 50 attached to the post 40, a main body 20 attached to the flange 44 of the post 40, the main body 20 having an engageable annular portion 23, and a fastener member 60 attached to the connector body 50, and an audio plug body 12 having a tube-like insulator body 80 extending from the post 40, the insulator body 80 having a first end 81, a second end 82, and an actuator 85 positioned somewhere on an outer surface 83 of the insulator body 80, wherein the insulator body 80 is radially disposed over a pin 30, the pin 30 having a tip 38 and an inner cavity 37, the inner cavity 37 having a socket 33 located therein, and a locking body 70 radially disposed over the insulator body 80, the locking body 70 having a wall thickness that tapers from a first thickness, $t_1$, to a second thickness, $t_2$, the second thickness, $t_2$, being greater than the first thickness, $t_1$, and rotating the locking body 70 in a first direction to place the audio plug body 12 in a locked position 110, wherein rotation of the locking body 70 in an opposing second direction returns the audio plug body 12 to an unlocked position 105.

The method may also comprise the step of increasing the circumference of the audio plug body 12 to engage the inner walls of a receptacle 5. The engagement of the audio plug 12 and the inner walls of the receptacle 5 may prevent disengagement of an audio plug connector device 100 from an audio source. The method may also involve expanding a diameter of the locking body 70 when the locking body 70 rotates about the insulator body 80. Minimal twisting of the locking knob 75 may prevent disengagement of audio plug connector device 100 from an audio source, or receptacle 5. Moreover, a method to lock an audio plug 12 into a receptacle 5 may include the step of expanding the locking body 70 from a first diameter, $D_1$, to a second diameter, $D_2$, to prevent disengagement from a receptacle 5. The increase in diameter of the locking body creates interference between the inner wall, or inner surface, of the receptacle 5 and the outer wall, or outer surface, of the locking body 70. The position of interference may also mean that the audio plug 12 exerts a radially outward force against the inner wall of the receptacle 5 to prevent disengagement of the audio plug 12 from the receptacle 5. Those in the art should appreciate that the locking body 70 should be resilient, semi-rigid, or suitable for expansion, and made out of conducting material.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. An audio plug connector device comprising:

an audio plug body;

a connector portion coupled to the audio plug body;

an expanding member extending from the audio plug body, wherein the expanding member radially expands from a first diameter to a second diameter to prevent disengagement from a receptacle; and an insulator body axially aligned within the expanding member, the insulator body having an actuator protruding from an outer surface of the insulator body to expand the expanding member from the first diameter to the second diameter when engaging a tapered inner surface of the expanding member.

2. The audio plug connector device of claim 1, wherein the expanding member is resilient and conductive.

3. The audio plug connector device of claim 1, wherein the insulator body and the actuator are rigid and formed from insulator materials.

4. The audio plug connector device of claim 1, wherein the connector portion includes a connector body, a post, and a fastener member, and receives a prepared coaxial cable.

5. A device comprising:

a connector portion, wherein the connector portion receives a coaxial cable;

an audio plug attached to the connector portion, the audio plug having an outermost conductor, wherein an expansion of the outermost conductor increases a circumference of the audio plug to tighten interference between the audio plug and a receptacle; and wherein the audio plug includes an insulator body axially aligned with the outermost conductor, the insulator body having an actuator protruding from an outer surface of the insulator body, the actuator engaging a tapered inner surface of the outermost conductor to increase the circumference of the audio plug.

6. The device of claim 5, further comprising:

a rotatable element connected to the outermost conductor to facilitate expansion of the outermost conductor, wherein the rotatable element is radially disposed on the audio plug.

7. The device of claim 5, wherein the outermost conductor is resilient.

8. An audio plug comprising:

a connector portion having a post, the post having a first end and a second end, wherein a flange is located on the post proximate the second end, a connector body attached to the post, a main body attached to the flange of the post, the main body having an engageable annular portion, and a fastener member attached to the connector body;

a tube-like insulator body extending from the post, the insulator body having a first end, a second end, and an actuator positioned somewhere on an outer surface of the insulator body, wherein the insulator body is radially disposed over a pin, the pin having a tip and an inner cavity, the inner cavity having a socket located therein; and a locking body radially disposed over the insulator body, the locking body having a wall thickness that tapers from a first thickness to a second thickness, the second thickness being greater than the first thickness;

wherein the actuator engages the locking body to expand a diameter of the locking body when the locking body rotates about the insulator body.

9. The audio plug of claim 8, wherein the locking body radially expands from a central axis to lock into an audio jack.

10. The audio plug of claim 8, further comprising:

a locking knob is connected to the locking body, facilitating the gripping and rotating of the locking body.

11. The audio plug of claim 8, wherein the locking body is resilient.

12. A locking audio plug connector comprising:

a connector portion having a post, the post having a first end and a second end, wherein a flange is located on the post proximate the second end, a connector body attached to the post, a main body attached to the flange of the post, the main body having an engageable annular portion, and a fastener member attached to the connector body; and an audio plug coupled to the connector portion and configured to be inserted into a receptacle, the audio plug including a tubular member extending from the flange of the post, a pin being generally surrounded by the tubular member, and a shielding member generally surrounding the tubular member;

wherein rotation of the shielding member in a first direction places the audio plug in a locked position, and rotation of the shielding member in an opposing second direction returns the audio plug to an unlocked position.

13. The locking audio plug connector of claim 12, further comprising:

an actuator located on an outer surface of the tubular member, wherein the rotation of the shielding member facilitates an engagement between the actuator and the tapered inner surface of the shielding member.

14. The locking audio plug connector of claim 12, wherein the shielding member is resilient.

15. A method of locking an audio plug into an audio jack comprising:

providing a connector portion having a post, the post having a first end and a second end, wherein a flange is located on the post proximate the second end, a connector body attached to the post, a main body attached to the flange of the post, the main body having an engageable annular portion, and a fastener member attached to the connector body, and an audio plug body having a tube-like insulator body extending from the post, the insulator body having a first end, a second end, and an actuator positioned somewhere on an outer surface of the insulator body, wherein the insulator body is radially disposed over a pin, the pin having a tip and an inner cavity, the inner cavity having a socket located therein, and a locking body radially disposed over the insulator body, the locking body having a wall thickness that tapers from a first thickness to a second thickness, the second thickness being greater than the first thickness; and rotating the locking body in a first direction to place the audio plug body in a locked position, wherein rotation of the locking body in an opposing second direction returns the audio plug body to an unlocked position.

16. The method of claim 15, wherein the audio plug body is configured to be inserted into a receptacle.

17. The method of claim 15, further comprising:

increasing the circumference of the audio plug body to engage the inner walls of the receptacle.

18. The method of claim 15, wherein the locking body is resilient.

* * * * *